US008430183B2

(12) United States Patent
Di Nicolantonio et al.

(10) Patent No.: US 8,430,183 B2
(45) Date of Patent: Apr. 30, 2013

(54) AUXILIARY HANDLE, AND HAND POWER TOOL PROVIDED THEREWITH

(75) Inventors: Aldo Di Nicolantonio, Recherswil (CH); Robert Simm, Oekingen (CH); Christian Heine, Nuertigen (DE); Simon Isch, Bern (CH)

(73) Assignee: Robert Bosch GmbH, Stuttgart (DE)

( * ) Notice: Subject to any disclaimer, the term of this patent is extended or adjusted under 35 U.S.C. 154(b) by 979 days.

(21) Appl. No.: 10/959,796

(22) Filed: Oct. 6, 2004

(65) Prior Publication Data

US 2005/0082072 A1 Apr. 21, 2005

(30) Foreign Application Priority Data

Oct. 15, 2003 (DE) ..... 103 47 944

(51) Int. Cl.
*B25D 17/04* (2006.01)

(52) U.S. Cl.
USPC ..... 173/162.2; 173/162

(58) Field of Classification Search ..... 173/162, 173/162.2; 16/426
See application file for complete search history.

(56) References Cited

U.S. PATENT DOCUMENTS

| | | | | | |
|---|---|---|---|---|---|
| 3,571,874 | A | * | 3/1971 | Von Arz | 29/81.14 |
| 3,876,014 | A | * | 4/1975 | Moores, Jr. | 173/47 |
| 4,371,043 | A | * | 2/1983 | Kubokawa | 173/162.2 |
| 4,421,181 | A | * | 12/1983 | Andersson et al. | 173/162.2 |
| 4,643,263 | A | * | 2/1987 | Karden | 173/168 |
| 4,667,749 | A | * | 5/1987 | Keller | 173/162.2 |
| 4,936,394 | A | * | 6/1990 | Ohtsu | 173/162.2 |
| 5,157,807 | A | | 10/1992 | Keller et al. | |
| 5,273,120 | A | * | 12/1993 | Chang | 173/162.2 |
| 5,365,637 | A | * | 11/1994 | Bodell et al. | 16/431 |
| 5,453,577 | A | * | 9/1995 | Everett et al. | 173/211 |
| 5,692,574 | A | * | 12/1997 | Terada | 173/162.2 |
| 5,697,456 | A | | 12/1997 | Radle et al. | |
| 5,881,822 | A | * | 3/1999 | Sienkiewycz et al. | 173/162.2 |
| 6,026,910 | A | * | 2/2000 | Masterson et al. | 173/162.2 |
| 6,763,747 | B1 | * | 7/2004 | Gierer et al. | 81/489 |
| 6,863,479 | B2 | * | 3/2005 | Frauhammer et al. | 408/241 R |
| 2001/0011846 | A1 | * | 8/2001 | Krondorfer et al. | 310/17 |
| 2002/0197939 | A1 | | 12/2002 | Frauhammer et al. | |
| 2004/0016082 | A1 | | 1/2004 | Yi | |
| 2006/0005357 | A1 | * | 1/2006 | Kemmler et al. | 16/430 |
| 2006/0025060 | A1 | * | 2/2006 | Funk | 451/358 |
| 2008/0148525 | A1 | | 6/2008 | Krondorfer et al. | |

FOREIGN PATENT DOCUMENTS

| | | | |
|---|---|---|---|
| CN | 1319477 | | 10/2001 |
| DE | 28 04 223 | * | 2/1979 |
| DE | 28 04 223 | | 8/1979 |
| DE | 100 05 080 | | 8/2001 |

* cited by examiner

*Primary Examiner* — Hemant M Desai
*Assistant Examiner* — Gloria R Weeks
(74) *Attorney, Agent, or Firm* — Michael J. Striker

(57) ABSTRACT

An auxiliary handle for a motor-driven hand tool has a mounting device which forms an upper region and provides a force-transmitting and/or form-locking connection to a hand tool; a handle forming a lower region, a damping element forming an intermediate region and located at least locally between the mounting device and the handle, the damping element having a damping material with which, during an operation of a hand tool, it dampens vibration transmitted through the mounting device to the handle, the damping element in its damping region acting for damping having at least one reinforcing region that has a lower deformability than a remaining part of the damping region and during deviations of the handle in at least two different directions relative to the mounting device causes differently great elastic counter forces.

9 Claims, 2 Drawing Sheets

AUXILIARY HANDLE, AND HAND POWER TOOL PROVIDED THEREWITH

BACKGROUND OF THE INVENTION

The present invention relates to an auxiliary for a motor-driven hand tool, as well as to a motor-driven hand tool provided therewith.

Auxiliary handles of the above mentioned type are known. They substantially include a mounting device and a handle. When the user of a motor-driven hand tool uses an auxiliary handle it can hold the hand tool during the operation with both hands and guide it correspondingly. If a hand tool during the work application needs an additional force consumption of the user in the working direction of the hand tool, in particular pressing of a power drill in direction of the longitudinal extension of the used drill, then with the auxiliary handle the user can apply the required force with two hands or arms. By means of the auxiliary handle, therefore greater hand tools or such tools which during the operation require a higher force consumption, can be operated more comfortably and more reliably.

In hand tools which must be however guided and/or held by the user, for example an angle grinder, a vibration-dampened handle disclosed in the prior art could be advantageously utilized. A region of the auxiliary handle, conventionally between the mounting device and the handle, is composed of an elastic plastic material. Thereby the vibrations of the hand tool received by the mounting device are transferred to the handle in a dampened fashion. Therefore the user of the hand tool performs the work in pleasant fashion, since the hand of the user embracing the handle is subjected to low vibrations.

With hand tools, in which during the operation the operator must apply a directional force, conventionally by pressing in direction of the working region, it is disadvantageous that the handle during the utilization of the tool has only a spongy and inaccurate feel for the operator during guidance of the hand tool. Therefore the force application can be dosed only inaccurately, which leads to a not precise work with the hand tool.

SUMMARY OF THE INVENTION

Accordingly, it is an object of the present invention to provide an auxiliary handle as well as a hand tool, provided therewith which eliminate the disadvantages of the prior art.

In keeping with these objects and with others which will become apparent hereinafter, one feature of the present invention resides, briefly stated, in an auxiliary handle for a motor-driven hand tool, comprising a mounting device which forms an upper region and provides a force-transmitting and/or form-locking connection to a hand tool; a handle forming a lower region; a damping element forming an intermediate region and located at least locally between said mounting device and said handle, said damping element having a damping material with which, during an operation of a hand tool, it dampens vibrations transmitted through said mounting device to said handle, said damping element in its damping region acting for damping having at least one reinforcing region that has a lower deformability than a remaining part of said damping region and during deviations of said handle in at least two different directions relative to said mounting device causes differently great elastic counter forces.

When the auxiliary handle is designed in accordance with the present invention, it has the advantage that the damping element with a damping material damps vibrations which during the operation of the hand tool are transmitted via the mounting device to the handle, and simultaneously the force applied by the user in the working direction is transmitted substantially directly to the hand tool and the operator obtains an accurate feedback about the work in progress in the working direction. At least one reinforcing region acts so that a lower deformability is provided that the remaining damping region, during deviations of the handle in at least two different directions relative to the mounting direction with differently great, elastic counter forces.

The deviations include first of all such movements of the handle, by which the handle moves within a swaying cone with a center axis corresponding to the longitudinal central axis of the handle in the stationary condition. The damping during the deviation of the handle exclusively along its longitudinal central axis is not taken into consideration in the embodiments of this invention.

For the working application it is especially important that a deviation of the handle in direction of the working direction of the hand tool counteracts another counter force than a deviation in a lateral direction extending transversely to it. For clarification of the term "working direction" it should be mentioned that in a power drill the working direction coincides with a longitudinal extension of the used drill, but in a screwdriver the working direction coincides with a longitudinal extension of the screw insert and with a longitudinal extension of the screw to be screwed in.

Advantageously, the at least one reinforcing region is located in a plane which is defined by an axis extending parallel to the working direction of the hand tool and the longitudinal central axis of the auxiliary handle. This provides on the one hand a reinforcement in the working direction of the hand tool, and on the other hand provides a lateral deviation to a side substantially opposite to the same counter force as a mirror symmetrical deviation to the above mentioned plane to another side.

In an advantageous embodiment of the present invention, when considered along the working direction of the hand tool, at least one reinforcing region is arranged forwardly and at least one reinforcing region is arranged rearwardly of the longitudinal central axis of the auxiliary handle. Thereby the same reinforcing action is provided for pushing and pulling forces along the working direction of the hand tool.

It is advantageous when the at least one reinforcing region is composed of a material which is different from the damping material. The reinforcing region thereby is formed so that a material with a lower damping property, for example a reduced elasticity, is utilized when compared with the damping material.

In a preferable embodiment of the invention, the at least one reinforcing region is formed so that the damping element during the manufacture is formed differently in certain areas. For example it is possible to treat the damping element for forming the at least one reinforcing region locally with different temperatures. When the damping element is composed of a synthetic plastic, it is possible to determine locally the damping property of the damping element by introduction of fine air bubbles, wherein in the reinforcing region the number of the air bubbles per volume unit is reduced. Furthermore, a chemical reinforcement can be provided by a local introduction of hardening substances.

It is advantageous when the at least one reinforcing region is formed as a connecting element between the mounting device and the handle. Thereby the transition between the mounting device and the handle is stabilized. In addition the connecting element can be manufactured especially simple, since recesses for the passages of the connecting are required.

Advantageously, the at least one reinforcing region can be formed as a part of the handle. Therefore a further simplification of the manufacture of the auxiliary handle is provided.

In accordance with a preferable embodiment, the damping element is arranged in at least one recess which is substantially ring-shaped and extends in a plane that is substantially perpendicular to the longitudinal central axis of the auxiliary handle. The recesses can be provided with many variants. For example, the recess can be formed so that it is throughgoing, it can be also formed by individual ring segment-shaped recess elements which are spaced from one another.

For forming the at least one reinforcing region, the bores can be selected with a smaller depth and a smaller diameter, they also can be absent in certain areas for forming the at least one reinforcing region. Also, an arrangement of several recesses in several planes which are spaced from one another can be selected.

It is advantageous when the at least one reinforcing region is formed so that the recess in at least one region of its ring-shaped extension is reduced. Thereby the recess has a smaller thickness and/or a smaller depth and Therefore also the damping element in this region is reduced, so that the elasticity of the damping element in this region is reduced and the reinforcing region is formed.

The present invention also deals with a motor-driven hand tool, which has an auxiliary handle formed in accordance with the present invention.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
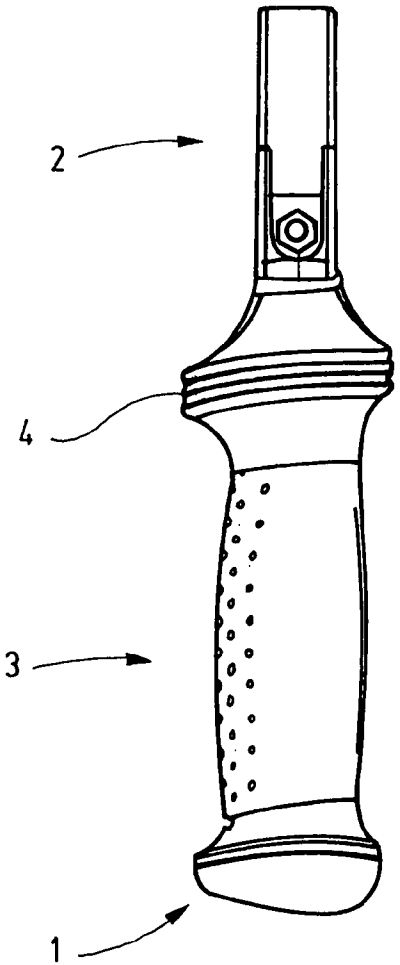
FIG. 1 is a side view of an auxiliary handle in accordance with the present invention.

FIG. 1 shows an auxiliary handle 1 with a mounting device 2, a handle 3 and a damping element 4 arranged between the mounting device 2 and the handle 3.

Before the use of the auxiliary handle 1, the auxiliary handle 1 is fitted with its mounting device 2 over the clamping collar of a not shown hand tool and is mounted there in force-transmitting (non-positive) manner and/or form-locking (positive) manner. The vibration that are generated during the operation of the hand tool are transmitted through the clamping collar to the mounting device 2. Because of the damping element 4, these vibrations reach the handle 3 only in a dampened fashion.

Figure 2:
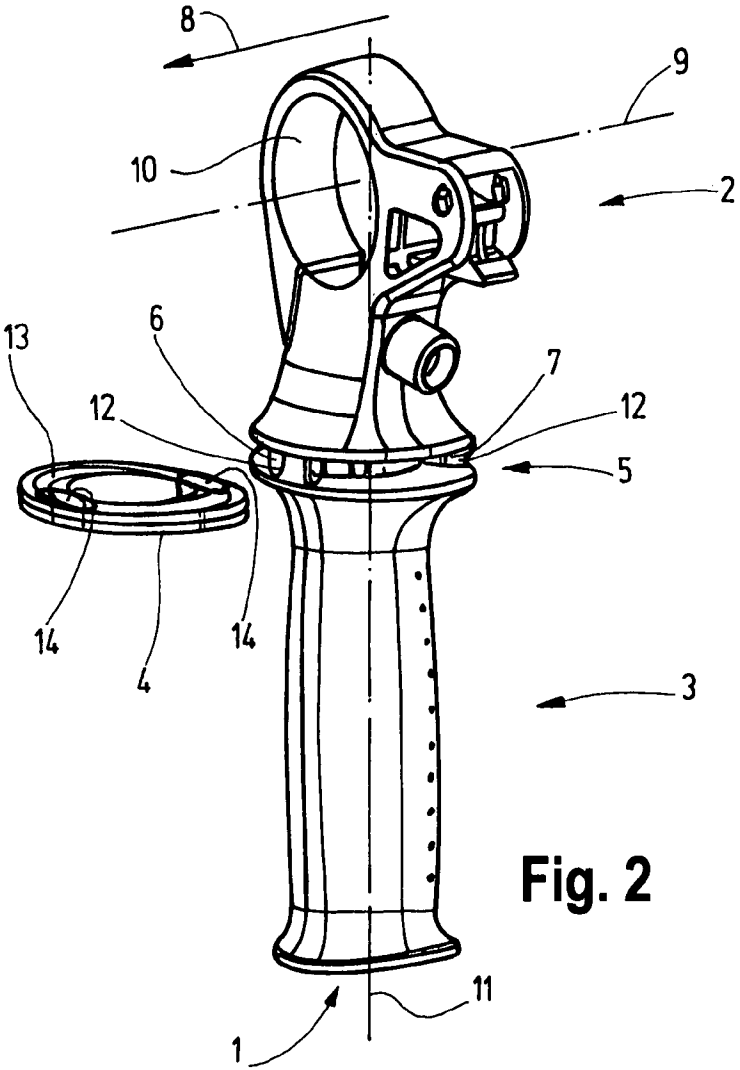
FIG. 2 is a front/side view of the auxiliary handle in accordance with the present invention.

FIG. 2 shows the auxiliary handle 1 in a front/slide view. The damping element 4, for clear visualization of the auxiliary handle, is removed. Two ribs-shaped reinforcing regions 6 and 7 are provided in an intermediate space 5 between the mounting device 2 and the handle. They are formed as parts of the handle 3. The working direction 8 of the hand tool extend parallel to circular surface normals 9 of a clamping ring 10 of the mounting device 2. The reinforcing regions 6, 7 are located substantially in a plane which is defined by the working direction 8 and a longitudinal central axis 11 of the auxiliary handle 1. When considering along the working direction 8 of the hand tool, the reinforcing region 7 is located forwardly and the reinforcing region 6 is located rearwardly of the longitudinal central axis 11 of the auxiliary handle 1.

The reinforcing regions 6 and 7 are formed as connecting elements 12 between the mounting device 2 and the handle 3. In the damping material 13 of the damping element 4, recesses 14 are provided for the connecting elements 12. When the auxiliary handle 1 is loaded in the working direction, than the handle 3 due to the elasticity of the reinforcing region 6, 7 which is lower than that of the damping material 13, yields less than during a lateral deviation, or in other words a deviation located outside a plane formed by the working direction 8 and the longitudinal central axis 11, which was the case before. By a variation of the parameters, for example elasticity of the damping material 13, damping of the reinforcing regions 6, 7, or the measurement of the connecting element 12, the desired damping properties can be adjusted. In particular, the difference in the elasticity during a deviation in the working direction 8 or a deviation which is lateral to it, can be adjusted.

Figure 3:
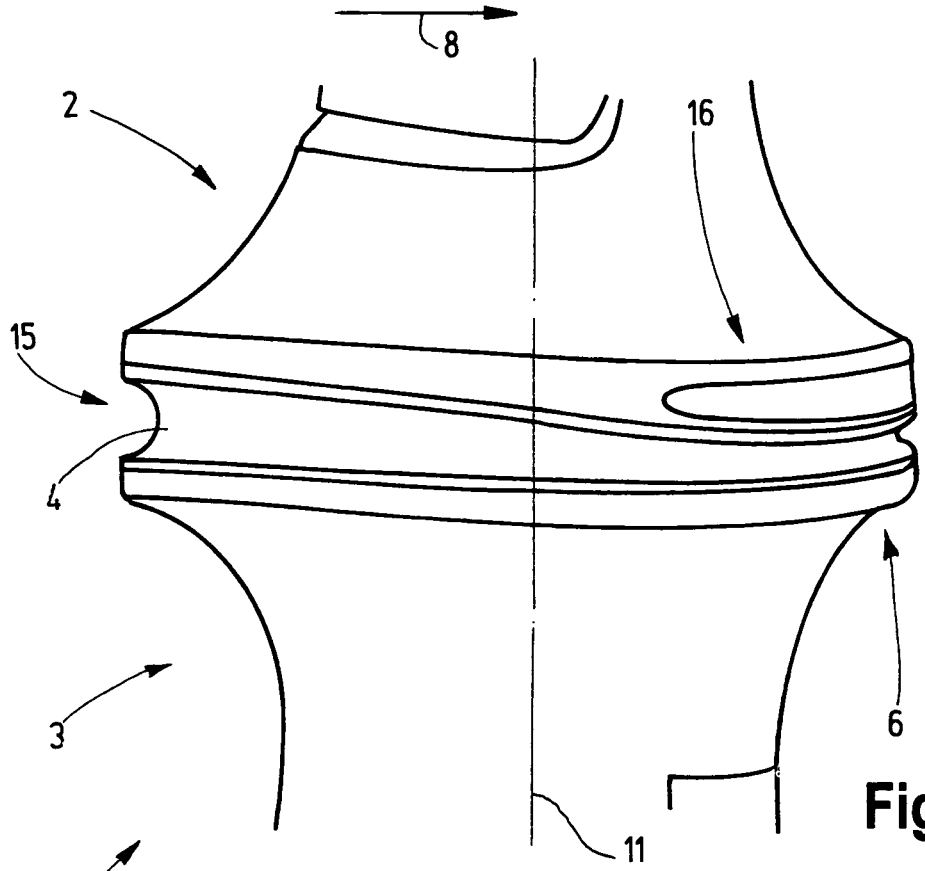
FIG. 3 is a detailed view of a used damping element in accordance with a further embodiment of an auxiliary handle of the present invention.

FIG. 3 shows a detailed view of a further embodiment of the auxiliary handle 1. Here the damping element 4 is arranged in a recess 15, which is formed substantially ring-shaped and extends in a plane substantially perpendicular to the longitudinal central axis 11 of the auxiliary handle 1. The reinforcing region 6 is formed in that the recess 15 is reduced in a region 16 of its ring-shaped extension. Such an arrangement has a good damping property. The damping in the working arrangement 8 is reduced so as to transmit the force application of the user substantially directly to the mounting device 2 and thereby to the hand tool.

Figure 4:
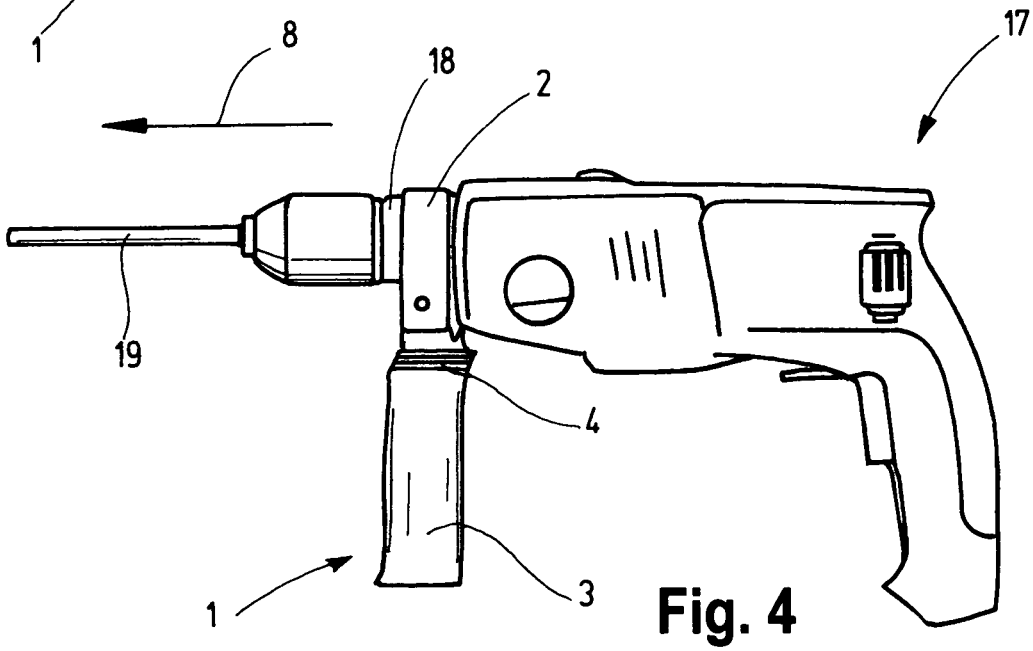
FIG. 4 is a view showing a motor-driven hand tool with an auxiliary handle in accordance with the present invention.

FIG. 4 shows a motor-driven hand tool 17 with an auxiliary handle 1. The auxiliary handle 1 is mounted on a clamping collar 18 of the hand tool 17 by the mounting device 2. The working direction 8, as shown, extends parallel to the longitudinal section of a drill 19.

It will be understood that each of the elements described above, or two or more together, may also find a useful application in other types of constructions differing from the types described above.

While the invention has been illustrated and described as embodied in auxiliary handle and hand power tool provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An auxiliary handle for a motor-driven hand tool, comprising a mounting device which forms an upper region and provides a force-transmitting and/or form-locking connection to said hand tool; a handle forming a lower region and having a longitudinal central axis; a damping element forming an intermediate region and located at least locally between said mounting device and said handle in an axial direction, said damping element having a damping material with which, during an operation of said hand tool, it dampens vibrations transmitted through said mounting device to said handle, said damping element having at least one reinforcing region in its damping region acting for damping said vibrations that has a lower deformability than a remaining part of said damping region and during deviations of said handle in at least two different directions relative to said mounting device causes differently great elastic counter forces, wherein when considered along an axis extending parallel to a working direction of the hand tool, one reinforcing region is arranged forwardly and one reinforcing region is arranged rearwardly to said longitudinal central axis of said handle and the remaining part of said damping region has a higher deformability than said reinforcing regions, with said one forwardly arranged reinforcing region and said one rearwardly arranged reinforcing region spaced from one another circumferentially around such longitudinal central axis of said handle, and said remaining part of said damping region being located between said one forwardly arranged reinforcing region and said one rearwardly arranged reinforcing region as considered in a circumferential direction around said central longitudinal axis such that a deviation of said handle in said working direction counteracts a greater counter force than a deviation of said handle in a lateral direction transversely to said working direction.

2. An auxiliary handle as defined in claim 1, wherein said at least one reinforcing region is composed of a material which is different from a material of said damping element.

3. An auxiliary handle as defined in claim 1, wherein said at least one reinforcing region is formed as a connection element between said mounting device and said handle.

4. An auxiliary handle as defined in claim 1, wherein said at least one reinforcing region is formed as a part of said handle.

5. An auxiliary handle as defined in claim 1; and further comprising at least one recess which is substantially ring-shaped and extends in a plane substantially parallel to a longitudinal central plane of the auxiliary handle, said damping element being arranged in said recess.

6. An auxiliary handle as defined in claim 5, wherein said at least one reinforcing region is formed by reducing a cross-section of said recess in at least one region of a ring-shaped extension of the recess.

7. An auxiliary handle as defined in claim 1, wherein said reinforcing regions are spaced from one another in a circumferential direction around said longitudinal central axis of said auxiliary handle.

8. A motor-driven hand tool, comprising a hand tool part; and an auxiliary handle including a mounting device which forms an upper region and provides a force-transmitting and/or form-locking connection to a hand tool, a handle forming a lower region and having a longitudinal central axis, a damping element forming an intermediate region and located at least locally between said mounting device and said handle in an axial direction, said damping element having a damping material with which, during an operation of a hand tool, it dampens vibrations transmitted through said mounting device to said handle, said damping element in its damping region acting for damping having at least one reinforcing region that has a lower deformability than a remaining part of said damping region and during deviations of said handle in at least two different directions relative to said mounting device causes differently great elastic counter forces, wherein when considered along an axis extending parallel to the working direction of the hand tool, one reinforcing region is arranged forwardly and one reinforcing region is arranged rearwardly to said longitudinal central axis and the remaining part of said damping region has a higher deformability that said reinforcing regions, with said one forwardly arranged reinforcing region and said one rearwardly arranged reinforcing region spaced from one another circumferentially around such longitudinal central axis of said handle and said remaining part of said damping region being located between said one forwardly arranged reinforcing region and said one rearwardly arranged reinforcing region as considered in a circumferential direction around said central longitudinal axis such that a deviation of said handle in said working direction counteracts a greater counter force than a deviation of said handle in a lateral direction transversely to said working direction.

9. An auxiliary handle for a motor-driven hand tool, whereby said hand tool has a working direction, comprising a mounting device which forms an upper region and provides a force-transmitting and/or form-locking connection to said hand tool, whereby the mounting device has an axis parallel to said working direction; a handle forming a lower region and having a longitudinal central axis; a damping element forming an intermediate region and located at least locally between said mounting device and said handle in an axial direction, said damping element having a damping material with which, during an operation of said hand tool, it dampens vibrations transmitted through said mounting device to said handle, said damping element having at least one reinforcing region in its damping region acting for damping said vibrations that has a lower deformability than a remaining part of said damping region and during deviations of said handle in at least two different directions relative to said mounting device causes differently great elastic counter forces, wherein when considered along said axis extending parallel to said working direction of the hand tool, one reinforcing region is arranged forwardly and one reinforcing region is arranged rearwardly to a longitudinal central axis of said handle and the remaining part of said damping region has a higher deformability than said reinforcing regions, with said one forwardly arranged reinforcing region and said one rearwardly arranged reinforcing region spaced from one another circumferentially around such longitudinal central axis of said handle and said remaining part of said damping region being located between said one forwardly arranged reinforcing region and said one rearwardly arranged reinforcing region as considered in a circumferential direction around said central longitudinal axis such that a deviation of said handle in said working direction counteracts a greater counter force than a deviation of said handle in a lateral direction transversely to said working direction.

* * * * *